US010657867B1

(12) United States Patent
Tiana et al.

(10) Patent No.: US 10,657,867 B1
(45) Date of Patent: May 19, 2020

(54) IMAGE CONTROL SYSTEM AND METHOD FOR TRANSLUCENT AND NON-TRANSLUCENT DISPLAYS

(71) Applicant: Rockwell Collins, Inc., Cedar Rapids, IA (US)

(72) Inventors: Carlo L. Tiana, Portland, OR (US); Travis B. Smith, Lake Oswego, OR (US); Weston J. Lahr, Sherwood, OR (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 1309 days.

(21) Appl. No.: 14/302,920

(22) Filed: Jun. 12, 2014

(51) Int. Cl.
*G09G 3/20* (2006.01)

(52) U.S. Cl.
CPC ..... *G09G 3/2003* (2013.01)

(58) Field of Classification Search
None
See application file for complete search history.

(56) References Cited

U.S. PATENT DOCUMENTS

2007/0241936 A1* 10/2007 Arthur ..... G01C 23/00 340/958
2008/0042953 A1* 2/2008 De Haan ..... G09G 3/20 345/89
2009/0112387 A1* 4/2009 Kabalkin ..... G05D 1/0044 701/23

* cited by examiner

*Primary Examiner* — Parul H Gupta
(74) *Attorney, Agent, or Firm* — Donna Suchy

(57) ABSTRACT

A system and method for controlling display characteristics is disclosed. The system and method can receive a control signal from a user interface and a video input signal. The system and method can filter the video input signal in accordance with a spatial frequency threshold related to the control signal to provide a filtered video output signal. The system and method can provide the filtered video output signal for display of an image on the translucent display and non-translucent display. The translucent display can be a head up display (HUD) and the non-translucent display can be a head down display. The user interface can be a brightness, contrast or combination brightness and contrast control.

20 Claims, 4 Drawing Sheets

IMAGE CONTROL SYSTEM AND METHOD FOR TRANSLUCENT AND NON-TRANSLUCENT DISPLAYS

BACKGROUND OF THE INVENTION

The present disclosure relates generally to the field of image or brightness and/or contrast control in display systems. More particularly, the present disclosure relates to image control for translucent and non-translucent displays.

Displays are utilized in a wide variety of applications including but not limited to medical, military, avionic, entertainment and computing applications. In one exemplary application, translucent or transparent displays are used in conjunction with non-translucent or non-transparent displays. Translucent displays allow a user to view an environment behind the display of information. Translucent displays include but are not limited to: head up display (HUD) systems and wearable displays, such as, helmet mounted display (HMD) systems. Non-translucent displays include but are not limited to: cathode ray tubes (CRT), backlit liquid crystal display (LCD), and projection systems where the user does not view objects behind the screen of the display. As used herein, the term translucent display includes transparent displays and the term non-translucent display includes non-transparent displays.

In aircraft applications, head up display systems and helmet mounted display systems allow the flight crew to maintain eye contact with the outside environment while simultaneously viewing information from aircraft systems and sensors in a graphical and alphanumeric format overlaying the outside world view. Head up display systems are known to provide conformal information such that displayed features overlay the environmental view. The displayed features can be sourced from a head up display computer, from a camera or other imaging sensor (such as a visible light imaging sensor, infrared imaging sensor, millimeter wave radar imager, etc.), or from a synthetic vision source. In aircraft applications, head down display (HDDs) systems are non-translucent displays that provide display information from aircraft instruments (e.g., traffic collision avoidance systems (TCAS), weather radar systems, flight management computers (FMC), flight instrumentation, etc.), from a camera or other imaging sensor (such as a visible light imaging sensor, infrared imaging sensor, millimeter wave radar imager, etc.), or from a synthetic vision source. Head up display systems and head down display systems also often display additional information related to aircraft controls, sensors, instruments, etc.

Conventional avionic systems with a head up display system and a head down display system generally include an independent control knob for brightness for the head up display system, an independent control knob for contrast for the head up display system, an independent control knob for brightness for the head down display system, and an independent control knob for contrast for the head down display system. Such independent control is used to provide image appearance control for images displayed on head up display systems and head down display systems and is conventionally believed to be necessary due to the different nature of those displays. Requirements for display image appearance are generally different for the translucent display system and the non-translucent display system because less obscuration of the environment viewable through the display in the translucent display system is desirable and more detail on the display in the non-translucent display system is desirable.

Independent contrast and/or brightness control for translucent display systems and non-translucent systems can be impractical or unfeasible. For example, in avionics applications, processing imagery through independent channels for enhanced, synthetic, and combination images adds to the cost of the avionic display system. Further, independent contrast and/or brightness control for head up display systems and head down display systems also adds to the pilot's cockpit resource management (CRM) tasks. Further still, independent contrast and/or brightness control for head up display systems and head down display systems provide a less consistent set of images to the user or pilot.

Accordingly, there is a need for a system and method of providing an optimal degree of brightness and/or contrast with minimal adjustments from a user for translucent and non-translucent display systems. There is a further need for systems for and methods of controlling image quality for translucent and non-translucent display systems without requiring a two knob interface. There is still a further need for systems for and methods of controlling brightness and contrast with a less complex user interface for head up display systems and head down display systems in an avionic environment. Yet further, there is a need for unified image control for head up display systems and head down display systems. There is also a need for a unified method for control of head-up and head-down display system brightness that, with a single setting, accomplishes the task of simultaneously balancing image appearance on the head up and head down display and provides the same image to different crewmembers who might be utilizing different head up or head down display systems. Finally, a unified method for control of head-up and head-down display system brightness that with a single setting accomplishes the task of simultaneously balancing image appearance on the head up and head down display is desirable in order to provide the same image to different crewmembers who might be utilizing different head up or head down display systems.

SUMMARY OF THE INVENTION

An exemplary embodiment relates to a method of controlling display content for a translucent display and a non-translucent display. The method includes receiving a control signal from a user interface, receiving a video input signal, and filtering the video input signal in accordance with a spatial frequency threshold related to the control signal to provide a filtered video output signal. The method further includes providing the filtered video output signal for display of an image on the translucent display and non-translucent display.

Another exemplary embodiment relates a brightness or contrast control system for an avionic display system. The avionic display system includes a user interface, an image source, a head down display and a head up display. The brightness or contrast control system includes a processor configured to receive a control signal from the user interface and image data from the image source. The processor is also configured to filter the image data in accordance with a spatial frequency parameter related to the control signal. The image data is used to provide an image on the head up display and an image on the head down display.

Another exemplary embodiment relates to computer executable instructions stored on a non-transitory computer readable storage medium, the instructions being executable to perform a method. The method includes receiving a control value associated with a brightness, contrast or combined brightness and contrast from a user interface, and filtering image data from an image source in accordance with a spatial frequency parameter related to the control signal. The image data represents an image for display on a translucent display and a non-translucent display.

Another embodiment relates to an apparatus for controlling display content including a single user adjustable interface configured to receive an input control signal. The apparatus also includes an algorithm that applies a spatial frequency filter according to the input control signal.

Yet another embodiment relates to a HUD or HMD system including a single user adjustable interface configured to output a control signal and a processor configured to provide spatial frequency filtering and an adjusted pixel intensity for each of a plurality of pixels associated with a video input signal in response to the output control signal.

BRIEF DESCRIPTION OF THE DRAWINGS

Exemplary embodiments are hereafter described, wherein like reference numerals denote like elements, and.

DETAILED DESCRIPTION OF THE PREFERRED EMBODIMENTS

Figure 1:
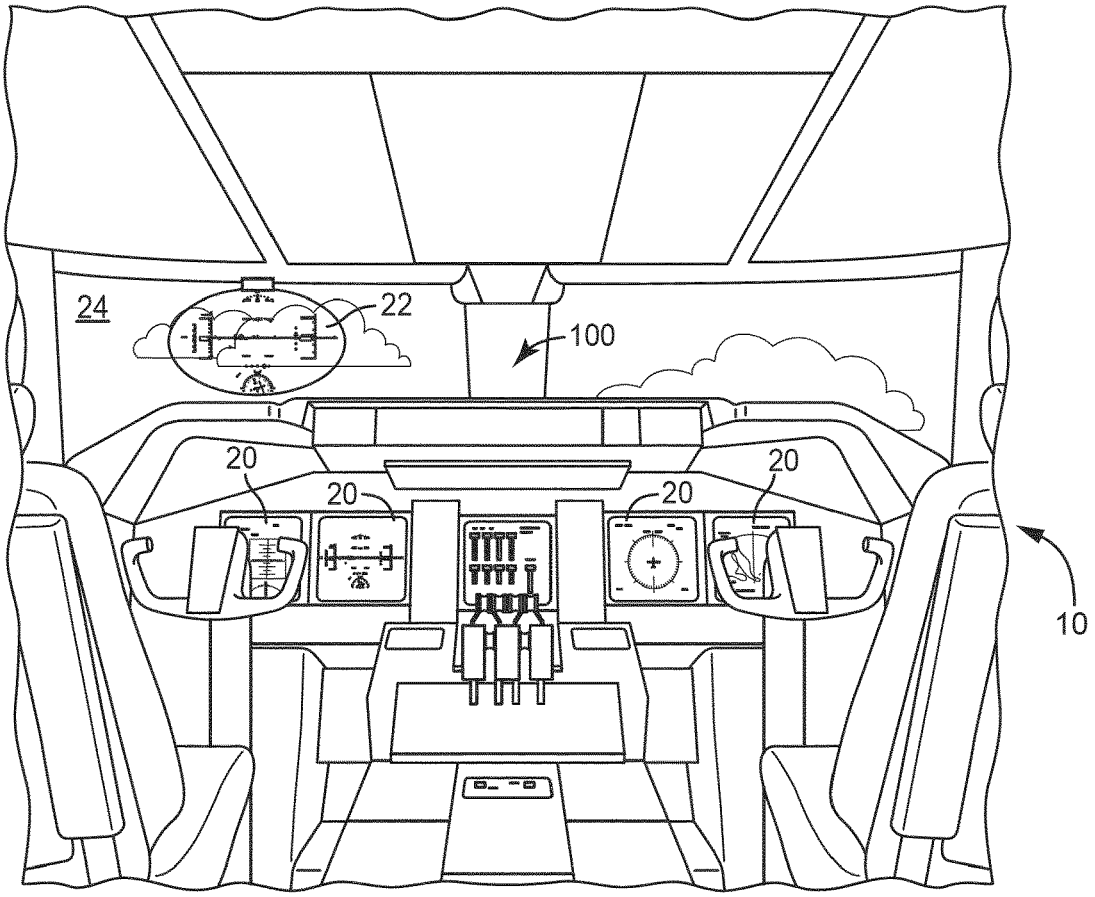
FIG. 1 is a perspective view of an aircraft control center including a display system with a translucent display and several non-translucent displays in accordance with an exemplary embodiment.

Before describing in detail the particular improved system and method, it should be observed that the invention includes, but is not limited to a novel structural combination of conventional data/signal processing components and communications circuits, and not in the particular detailed configurations thereof. Accordingly, the structure, methods, functions, control and arrangement of conventional components and circuits have, for the most part, been illustrated in the drawings by readily understandable block representations and schematic diagrams, in order not to obscure the disclosure with structural details which will be readily apparent to those skilled in the art, having the benefit of the description herein. Further, the invention is not limited to the particular embodiments depicted in the exemplary diagrams, but should be construed in accordance with the language in the claims.

Referring now to FIG. 1, an illustration of an aircraft control center 10 is shown according to an exemplary embodiment. Aircraft control center 10 may include a display system 100. Display system 100 includes various head down displays 20 and a head up display 22 which are used by the aircraft's pilot to increase visual range and enhance the pilot's situational awareness. Head down displays 20 are non-translucent displays, and head up display 22 is a translucent display in one embodiment.

Head up display 22 is located within aircraft control center 10 such that head up display 22 is directly within the pilot's field of vision when looking through windshield 24 of the aircraft. In contrast, head down displays 20 may be located within aircraft control center 10 below the window line, requiring the pilot to look in a downward direction to view head down displays 20 in one embodiment. Displays 20 and 22 can provide flight information display image, an enhanced vision display image or synthetic vision display image in one embodiment.

In one embodiment, display system 100 provides a contrast, brightness or brightness and contrast control that allows optimization of image quality and brightness for head up display 22 and head down displays 20. In one embodiment, display system 100 provides a control range between one extreme, optimal head down image presentation, and another extreme, optimal head up image presentation.

Display system 100 can provide a gradual transition between the two extremes across a control range in response to user inputs in one embodiment. In the control range, the image is adequate for presentation to either types of displays 20 and 22 according to one embodiment. In one embodiment, at higher brightness settings, the image contains a full spatial frequency spectrum. At lower brightness settings (e.g., as brightness is reduced), display system 100 reduces low spatial frequency contributions to the image in one embodiment. In other embodiments, other adjustments could increase brightness and reduce details.

The adjustment of the image's spatial frequencies has the effect of gradually reducing overall image brightness while preserving image detail in one embodiment. Image appearance changes from standard television-like imagery optimized for head down displays to an increasingly more optimal HUD presentation as brightness control is reduced in one embodiment. Further continued demand for reduction in image brightness reduces the image content to a high pass spatial frequency version of the image which removes brightness, preserves image detail and reduces green glow and occlusion of the outside world viewable through display 22.

According to one embodiment, display system 100 can apply another brightness control techniques in addition to spatial frequency filtering. In one embodiment, further reduction in brightening after the spatial frequency filter has reached a maximum result in an adjustment of pixel intensity in response to user inputs. In one embodiment, further reduction in brightening results in an adjustment of image intensity on a pixel-by-pixel basis rather than via spatial frequency filtering. According to one embodiment, as further brightness reduction is requested, a luminance reduction technique can be employed in one embodiment. The adjustment can be a reduction on a fixed level based on the brightness setting or on a ratio based on the brightness setting.

Advantageously, display system 100 allows an optimal image for the display characteristics of two different types of displays (e.g., translucent and non-translucent) if both present the same image. Display system 100 allows a common image display and control for displays 20 and 22 which is desirable from a cockpit resource management perspective where crews are required to crosscheck operations.

Although display system 100 is shown in FIG. 1 in an aircraft environment with head up display 22 and head down displays 20, the display system 100 can be used in other environments. The discussion and showing of the aircraft environment is exemplary. The principles described herein can be used in various applications, including transport applications, medical applications, entertainment applications, etc. without departing from the scope of the invention.

In one embodiment, head up display 22 may be partially transparent, allowing the pilot to partially see through display 22 and windshield 24. For example, display 22 may display data that appears as an overlay to the pilot's field of view through display 22. In one embodiment, head up display 22 can display an image using data received from an infrared sensor or a synthetic vision system. In one embodiment, head down display 20 can display similar images.

Display system 100 may be configured to provide data regarding the state of the aircraft to head down displays 20 and/or head up display 22. For example, data regarding the aircraft's altitude, heading, velocity, etc., may be provided to head down displays 20 and/or head up display 22 by processing electronics or other equipment. Display system 100 may be further configured to provide data regarding the external surroundings of the aircraft to head down displays 20 and/or head up display 22. The data can be conformally represented in the real world scene on head up display 22 in one embodiment.

Aircraft can receive data regarding the aircraft's surroundings from onboard sensors. For example, the aircraft may be equipped with radar that performs vertical and horizontal radar sweeps in front of the aircraft. Radar returns can be processed to generate and provide display data to head down displays 20 and head up display 22 regarding the external surroundings of the aircraft. For example, head down displays 20 may provide a top-down view, a horizontal view, a vertical view, or any other view of weather, terrain, objects, and/or other aircraft detected by processing electronics onboard the aircraft.

Aircraft can also receive data regarding the aircraft's surroundings communicated from an external source (e.g., a satellite, another aircraft, a ground based communications station, etc.). In various embodiments, communication devices in the aircraft may be configured to receive and/or transmit data with the external sources. For example, the aircraft may request data regarding the location and bearing of nearby aircraft via the communication devices. The returned data may then be processed and used to provide information regarding the other aircraft to the pilot via head down displays 20 and head up display 22.

A terrain database can be used to generate a synthetic view of the aircraft's surroundings. For example, a stored terrain database may include data regarding the shape, size and location of terrain. In some embodiments, the terrain database may also include data regarding man-made structures, such as antennas, buildings, bridges, and the like. The terrain database may also include data regarding the layout and location of airports. For example, the database may include data regarding the location of an airport's runways, control tower, etc. In other embodiments, the terrain database can include a chart database configured to store airport diagrams, approach charts, etc.

Display system 100 may generate a partially or fully virtual rendition of the aircraft's surroundings using the terrain database, radar returns, other sensor data, and data regarding the aircraft's altitude, bearing and heading. A 3-D representation of the scenery in front of the aircraft can be provided to head up display 22 and to one or more of head down displays 20. The rendition may also include various indicia regarding the current state of the aircraft. For example, the rendering on head up display 22 or flight display 20 may include data regarding the aircraft's heading, course, altitude, or the like. In further embodiments, the rendering may include a warning generated by a traffic collision avoidance system (TCAS) or terrain awareness and avoidance system (TAWS) of the processing electronics.

Display system 100 may be implemented in a wide variety of systems that accept input control signals to control display content on translucent and non-translucent displays. For example, system 100 may be implemented in systems including but not limited to military targeting systems, medical imaging display systems, wearable displays, land based vehicle head up display, helmet mounted display, or head down display systems, naval head up display, helmet mounted display or head down display systems, or aircraft head up display, helmet mounted display or head down display systems. Displays 20 and 22 can be of any type including any variety of pixilated displays, including, but not limited to a liquid crystal displays (LCDs).

Figure 2:
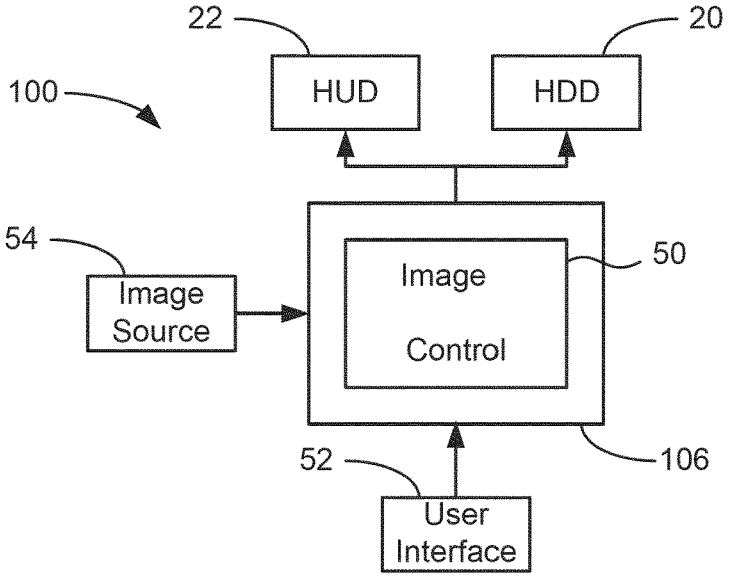
FIG. 2 is a general block diagram of one embodiment of the display system illustrated in FIG. 1 in accordance with an exemplary embodiment.

With reference to FIG. 2, display system 100 includes a head up display 22, a head down display 20, a display computer 106, an image source 54 and a user interface 52. Image source 52 can be any device for providing an image or image data to display computer 106. Display computer 106 provides a display signal or other data for providing a unified image that is presented on displays 20 and 22 in one embodiment.

In one embodiment, image source 54 can be a camera, visible or infrared imaging sensor, millimeter wave control radar imager, synthetic vision source, or other aircraft instrumentation. In one embodiment, display computer 106 can be a processing platform, a video processor or other device for providing data or video signals corresponding to images presented on displays 20 and 22. Display computer 106 can be a stand-alone device or be part of image source 54, user interface 52, displays 20 or 22, or other equipment (e.g., part of a head up display computer, cockpit equipment, etc.).

User interface 52 can be a dial, sliding mechanism, knob, button, touch screen, or any other type of analog or digital user interface capable of producing a control signal 160 indicative of image control (e.g., a desired level of brightness or contrast). In one embodiment, user interface 52 is disposed with display 20 or 22. In one embodiment, user interface 52 provides a digital or analog control signal to display computer 106.

In one embodiment, display computer 106 includes an image control unit 50. Image control unit 50 can be a brightness control unit, contrast control unit or combination brightness and contrast control unit in one embodiment. In one embodiment, image control unit 50 is a hardware device or software routine operating on a processing platform, such as display computer 106. Although shown in display computer 106, image control unit 50 can be provided within image source 50, such as, within a camera, a synthetic vision system, and a head up display computer or other device in one embodiment.

Image control unit 50 can control image quality of the image on displays 20 and 22 in accordance with a control signal provided by user interface 52. Image control unit 50 can adjust the image in accordance with a spatial frequency filter and/or image intensity or brightness control operations in one embodiment. Image control unit 50 can perform an image intensity control brightness operation to adjust the pixel intensity on a pixel-by-basis in accordance with a level of the control signal.

Figure 3:
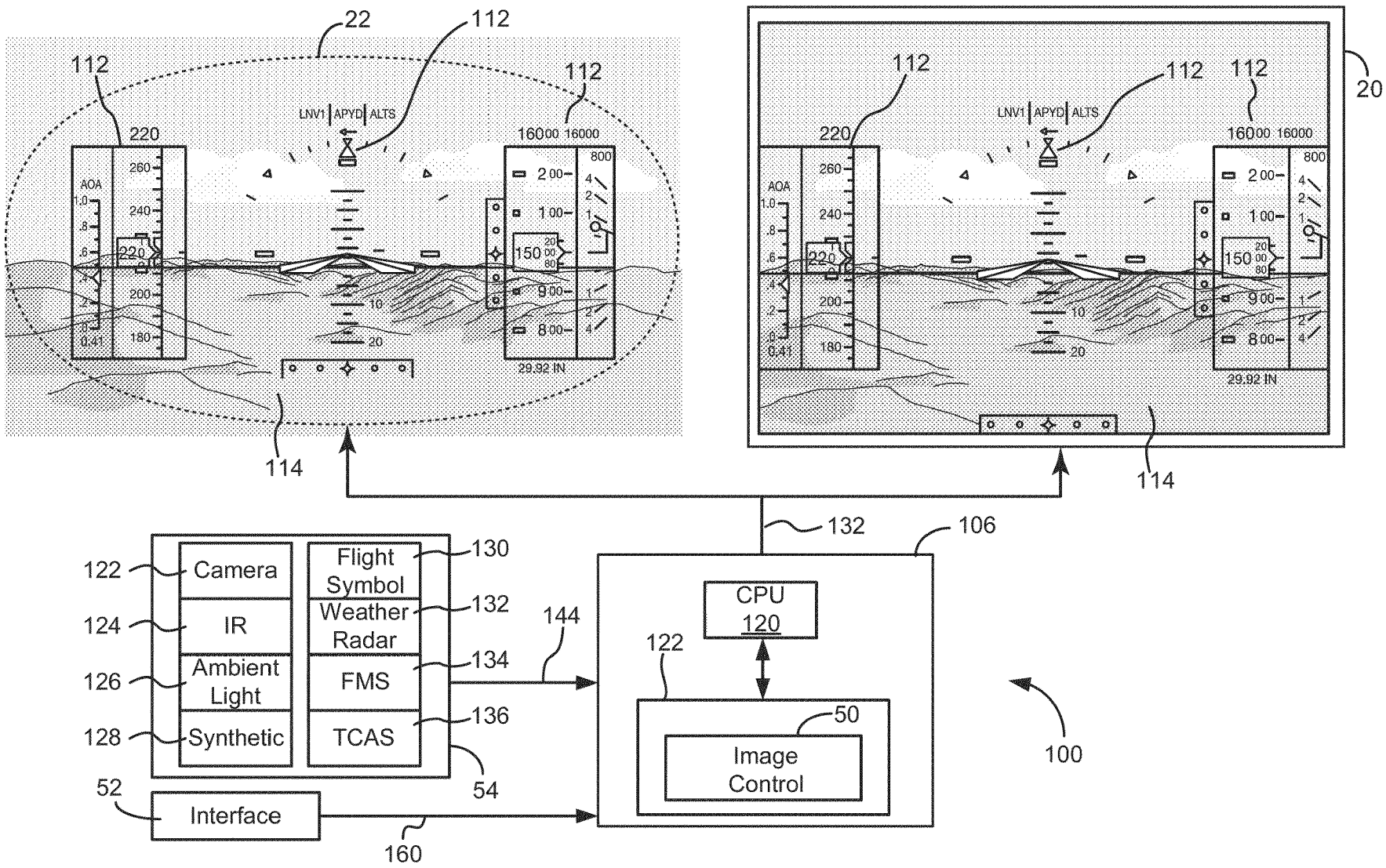
FIG. 3 is a more detailed block diagram of the display system illustrated in FIG. 2 in accordance with an exemplary embodiment.

With reference to FIG. 3, display system 100 includes display computer 106 including a processor 120 and a memory 123 and an image source 54 including at least one of a camera 122, an IR sensor 124, a synthetic image source 128, a traffic collision avoidance system 136, a flight symbol generator 130 (e.g., a HUD computer), weather radar system 132, and/or a flight management system 134. in one embodiment. Memory 123 can be a non-transitory medium for storing an algorithm associated with image or brightness/contrast control as a set of computer instructions in one embodiment. Displays 20 and 22 can display an environmental image 114 as well symbology 112.

Image source 54 can also include an ambient light sensor 127. Ambient light sensor 127 can be a photonic device for sensing light conditions in the environment of the displays 20 and 22. The control signal from interface 52 or images on displays 20 and 22 can be adjusted in accordance with the ambient light conditions sensed by ambient light sensor 127 in one embodiment. Ambient light sensor 127 can be part of user interface 52 or display computer 106 in one embodiment.

Image source 54 can provide image data to computer 106 from a number of sources. Image source 54 can provide image data from one or more of camera 122, IR sensor 124, synthetic image source 128, traffic collision avoidance system 136, flight symbol generator 130, weather radar system 132, or flight management system 134 in one embodiment. Images from any one or more of camera 122, IR sensor 124, synthetic image source 128, traffic collision avoidance system 136, flight symbol generator 130, weather radar system 132, or flight management system 134 can be merged or otherwise provided for display on displays 20 and 22. Image data provided at output 144 of source 54 is subject to brightness control according to image control unit 50 such that images with the same brightness, contrast or brightness and contrast adjustments are provided via output 121 for presentation on displays 20 and 22 in one embodiment.

In one embodiment, a control signal from user interface 52 corresponds to a user's (e.g., pilot's) desired level of brightness for display system 100. In one embodiment for example, the level can correspond to a degree of spatial filtering, which is adjusted in response to the level of the control signal. In another embodiment, the level can correspond to a level of pixel intensity for an incoming frame of video. In one embodiment, a pixel may have a level of pixel intensity or brightness from 0-255 which is adjusted by image control unit 50 in accordance with the control signal. This range can be normalized to a set of values between 0 and 1.

Figure 4:
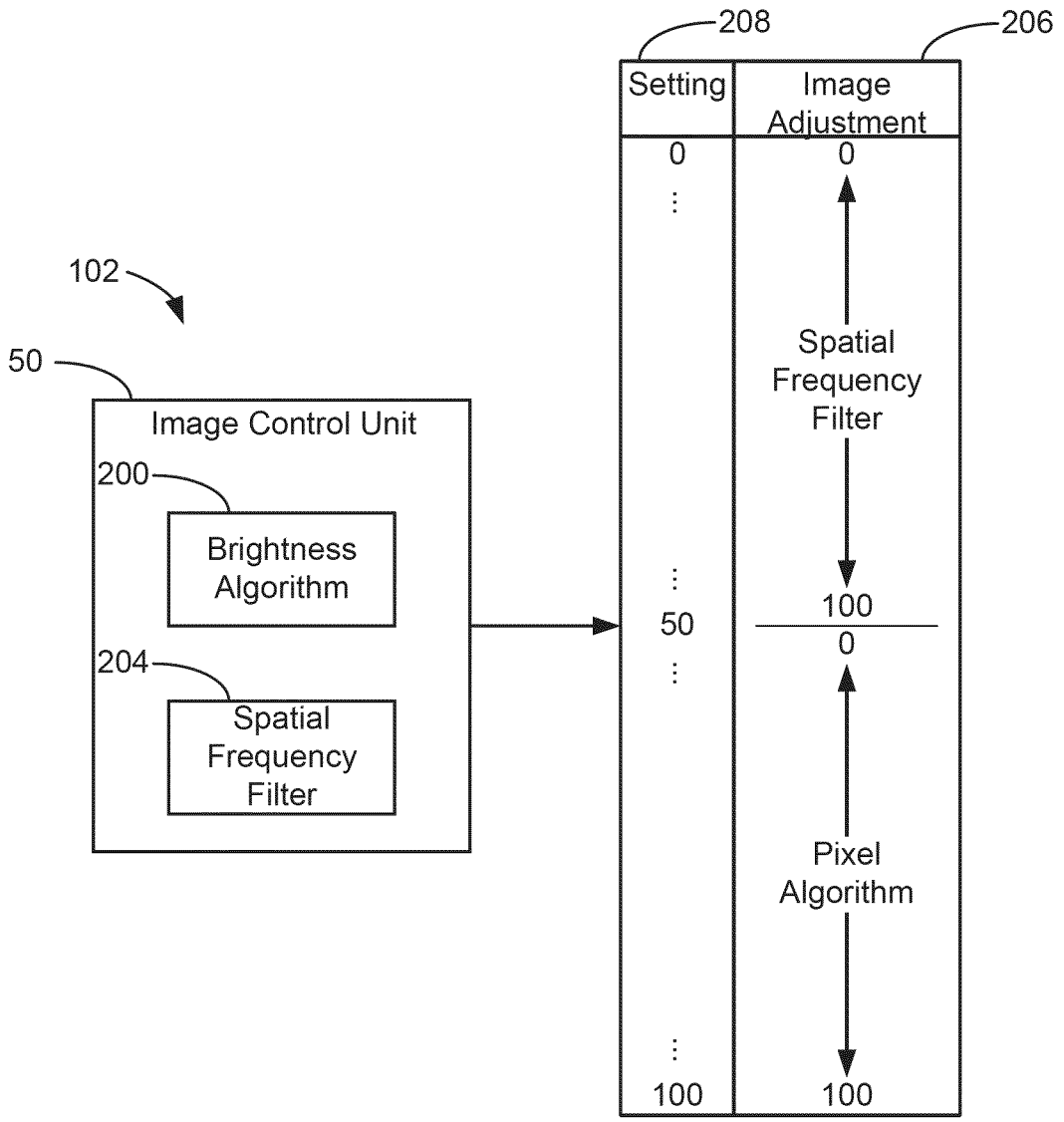
FIG. 4 is a more detailed block diagram of an image control unit for the display system illustrated in FIG. 2 in accordance with an exemplary embodiment.

With reference to FIG. 4, image control unit 50 can utilize a brightness algorithm 200 and a spatial frequency algorithm 204. Algorithms 200 and 204 are responsive to the level of the control signal or setting 208. A level of the control signal or setting 208 can be in a range from a minimum level 0 to a maximum level 100 in one embodiment. Numbers 0 and 100 are exemplary only.

At a zero level for setting 208 (corresponding to high brightness in one embodiment), the spatial frequency filter algorithm 204 provides a high pass frequency filtering of the image at its lowest frequency threshold in one embodiment. At a 50 level for setting 208 (corresponding to a lower brightness in one embodiment), the spatial frequency filter algorithm 204 provides a high pass frequency filtering of the image at its maximum frequency threshold in one embodiment. In one embodiment, the frequency threshold varies between its maximum and its minimum as a function of setting 208. The function can be a linear function, nonlinear function, piecewise function, etc.

After setting level 50, the threshold remains at the maximum. Although described with respect to setting 0, 50 and 100, other ranges can be utilized (e.g., 0 to 33 and 33 to 100, 0 to 66 and 67-100, etc.). In one embodiment, as setting 208 is increased (e.g., from 0 to 50), spatial frequency filter algorithm 204 slowly subtracts low spatial frequency content from the image and moves towards a higher spatial frequency content image. This transition causes the brightness of the image to be reduced in one embodiment.

Once setting 208 is greater than 50, image control unit 50 uses brightness algorithm 200 to adjust pixel intensity levels, such as luminous levels, associated with the video data. Minimum adjustments (downward) are made at level 50 and below and maximum adjustments (downward) are made at level 100. Maximum adjustments (upward) are made at level 50 and below and minimum adjustments (upward) are made at level 100. The adjustments can be made in accordance with any function including a linear function, nonlinear function, piecewise function, etc. In one embodiment, fixed adjustments are made in accordance with setting 208 or ratio adjustments are made in accordance with setting 208. As setting 208 is increased, the brightness of the image decreases due to a decrease in luminance in one embodiment.

In one embodiment, spatial frequency filter algorithm 204 can be a filter implemented in a digital signal processing circuit or other processor executing software. In one embodiment, spatial frequency filter algorithm 204 applies Fourier transform. Coefficients of the Fourier transform are adjusted to provide the appropriate spatial frequency threshold. In one embodiment, the spatial filtering algorithm uses pyramid decomposition, high-pass filtering, unsharp masking, etc. In one embodiment, brightness algorithm can be implemented in a digital signal processing circuit or other processor executing software.

Figure 5:
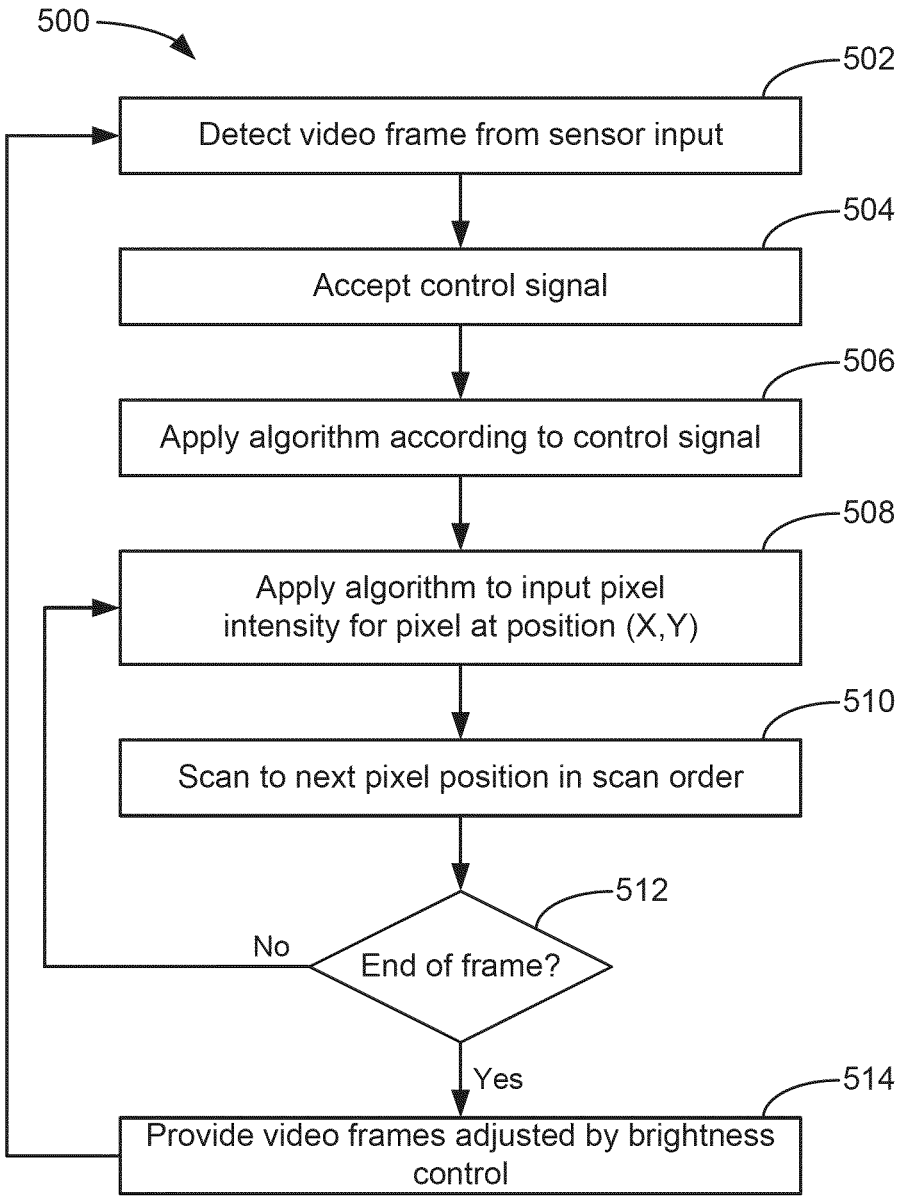
FIG. 5 is a flow diagram showing operation of the system illustrated in FIG. 2 according to one exemplary embodiment.

With reference to FIG. 5, display system 100 can operate according to a flow diagram 500. At a step 502, a video frame is provided from source 54 to computer 106. At a step 504, a control signal from interface 52 is provided. In one embodiment, the control signal is adjusted in accordance with an ambient light level detected by ambient light sensor 127.

At a step 506, image control unit 500 applies a brightness control or contrast control algorithm according to the level of the control signal. In one embodiment, spatial frequency filtering and pixel intensities can be adjusted by processing pixels on a pixel-by-pixel basis at a step 508 in one embodiment.

At a step 510, the next pixel position is filtered and/or image intensity adjusted in accordance with the control signal received at step 504. At a step 512, an end of frame status of the pixel is determined. If an end of frame has occurred, flow 500 advances to a step 514 where the video frame adjusted by image control unit 50 is provided for display on displays 20 and 22 in one embodiment. If the end of frame is not reached, the next pixel is processed in accordance with the brightness control in accordance with the operations of the image control unit 50.

Because the content of symbology and video content are independently generated in certain systems, two different processes can govern the degree of pixel intensity chosen for each component. Symbology pixel intensity can be drawn by display system 100 at maximum intensity for all symbology pixels in one embodiment. In one embodiment, image control unit 50 does not change pixel intensity.

While the detailed drawings, specific examples, and particular formulations given describe preferred and exemplary embodiments, they serve the purpose of illustration only. The inventions disclosed are not limited to the specific forms shown. For example, the methods may be performed in any of a variety of sequence of steps. The hardware and software configurations shown and described may differ depending on the chosen performance characteristics and physical characteristics of the computing devices. For example, the type of computing device, communications bus, or processor used may differ. The systems and methods depicted and described are not limited to the precise details and conditions disclosed. Furthermore, other substitutions, modifications, changes, and omissions may be made in the design, operating conditions, and arrangement of the exemplary embodiments without departing from the scope of the invention as expressed in the appended claims.

What is claimed is:

1. A method of controlling display content for a translucent display and a non-translucent display, the method comprising:

receiving a brightness or contrast control signal from a user interface;

receiving a video input signal;

filtering the video input signal in accordance with a spatial frequency threshold related to the control signal to provide a filtered video output frame, the filtered video output frame being filtered by at least spatial frequency filtering; and providing the filtered video output frame for display of images corresponding to the filtered video output frame on the translucent display and the non-translucent display.

2. The method of claim 1, further comprising:

displaying the images associated with the filtered video frame on the translucent display and on the non-translucent display.

3. The method of claim 1, wherein the translucent display is in a head up display (HUD) system and the control signal is received from a single user adjustable interface for both the translucent display and the non-translucent display.

4. The method of claim 1, further comprising adjusting an intensity level on a pixel-by-pixel basis of the video input signal in response to the control signal.

5. The method of claim 4, wherein the adjusting step is performed when the control signal is equal to or above a level associated with a maximum level of the spatial frequency threshold.

6. The method of claim 1, wherein the filtering is performed using a Fourier transform.

7. The method of claim 1, wherein the control signal is associated with a position of the user interface, wherein the position is halfway between a minimum position and a maximum position when a maximum level of the spatial frequency threshold is reached.

8. The method of claim 1, wherein filtering is performed using a Fourier transform and coefficients of the Fourier transform are adjusted in accordance with the control signal.

9. The method of claim 1, wherein the non-translucent display is a head down display and the translucent display is a head up display.

10. The method of claim 1, wherein the input video signal is a data signal representing an enhanced image, a synthetic image or a sensor image.

11. A brightness control system for an avionic display system comprising a user interface, an image source, a head down display and a head up display, the brightness control system comprising:

a processor configured to receive a brightness or contrast control signal from the user interface and image data from the image source, the processor being configured to filter the image data in accordance with a spatial frequency parameter related to the control signal and provide a filtered image frame filtered by a spatial frequency filtering, wherein the filtered image frame corresponding to an image is used to provide the image on the head up display and the image on the head down display.

12. The brightness control system of claim 11, wherein the filtered image frame is filtered by a low pass spatial frequency filter.

13. The brightness control system of claim 11, wherein the filtered image frame comprises intensity data, wherein the intensity data is adjusted in response to the control signal being above a first threshold.

14. The brightness control system of claim 11, wherein the processor is configured to execute a software based Fourier transform algorithm to filter the image data.

15. A brightness control system for an avionic display system, comprising:

a user interface;

an image source;

a non-translucent display;

a translucent display; and a processor for executing computer executable instructions stored on a non-transitory computer readable storage medium, the instructions being executable to perform a method, the method comprising:

receiving a control value associated with a brightness, contrast or combined brightness contrast control of the user interface; and filtering image data from the image source in accordance with a spatial frequency parameter related to the control value to provide a filtered image frame, the image data representing an image corresponding to the filtered image frame for display on the translucent display and the non-translucent display.

16. The brightness control system of claim 15, wherein the control value is associated with a position of the use interface, wherein the position is halfway between a minimum position and a maximum position when the spatial frequency parameter is at maximum.

17. The brightness control system of claim 15, wherein filtering is performed using a Fourier transform and coefficients of the Fourier transform are adjusted in accordance with the control value.

18. The brightness control system of claim 15, wherein the image data is video frame data.

19. The brightness control system of claim 15, wherein the method further comprises adjusting an intensity of pixel values associated with the image data in accordance with the control value.

20. The brightness control system of claim 19, wherein the control value is associated with a position of the use interface, wherein the position is halfway between a minimum position and a maximum position when the spatial frequency parameter is at maximum, wherein the intensity of the pixel values is not adjusted until the maximum is reached.

* * * * *